US006553872B1

(12) United States Patent
Tse et al.

(10) Patent No.: US 6,553,872 B1
(45) Date of Patent: Apr. 29, 2003

(54) OVERHEAD LIGHT BULB CHANGER WITH SAFETY CATCH CANOPY

(76) Inventors: David T. Tse, 2850 Hunter Rd., Weston, FL (US) 33331; Jeffrey David Tse, 2850 Hunter Rd., Weston, FL (US) 33331

( * ) Notice: Subject to any disclaimer, the term of this patent is extended or adjusted under 35 U.S.C. 154(b) by 0 days.

(21) Appl. No.: 09/970,249

(22) Filed: Oct. 3, 2001

(51) Int. Cl.[7] ..... H01K 3/32

(52) U.S. Cl. ..... 81/53.11; 81/64; 294/19.1; 56/332

(58) Field of Search ..... 81/53.11, 53.12, 81/53.1, 64; 294/19.1, 19.3, 22, 23, 64.1; 49/461; 56/329–340

(56) References Cited

U.S. PATENT DOCUMENTS

| | | | | | |
|---|---|---|---|---|---|
| 406,744 | A | * | 7/1889 | Kriner | 56/332 |
| 1,541,839 | A | | 6/1925 | Metzler et al. | |
| 2,223,344 | A | * | 12/1940 | Grinnell | 81/53.11 |
| 2,243,106 | A | * | 5/1941 | Limbert | 81/53.11 |
| 2,556,701 | A | * | 6/1951 | Mozena | 81/53.11 |
| 2,634,998 | A | | 4/1953 | Flower | |
| 2,637,587 | A | | 5/1953 | Robinson | |
| 4,218,085 | A | | 8/1980 | Unger | |
| 5,148,723 | A | | 9/1992 | Newman, Sr. et al. | |
| 5,231,733 | A | * | 8/1993 | Dittman | 16/412 |
| 5,317,939 | A | * | 6/1994 | Marinescu | 81/53.11 |
| 5,371,658 | A | * | 12/1994 | Christie | 362/109 |
| 5,829,324 | A | * | 11/1998 | Secor | 81/53.11 |
| 6,223,628 | B1 | * | 5/2001 | Barron | 81/53.11 |

* cited by examiner

*Primary Examiner*—Joseph J. Hail, III
*Assistant Examiner*—Hadi Shakeri
(74) *Attorney, Agent, or Firm*—Patricia E. McQueeney

(57) ABSTRACT

This is a device for screwing in and out light bulbs located at elevated positions from floor level comprising a pole or telescoping tubes which interconnect, having at one end a suction attachment or clamping attachment to affix to the electrical lamp and thereby screw it in or out, with a canopy set on the pole or telescoping tube which can catch the light bulb in the event the suction or clamping attachment releases the light bulb.

15 Claims, 5 Drawing Sheets

OVERHEAD LIGHT BULB CHANGER WITH SAFETY CATCH CANOPY

BACKGROUND OF INVENTION

This invention relates to a device for use in changing light bulbs, which are sometimes called electric lamps, in elevated or hard to reach locations such as high ceilings where direct handling of the light bulbs cannot readily be done by the light bulb changer.

The prior art shows the use of suction attachments and capturing attachments at the end of a pole or telescoping tube to reach and engage the light bulb, so that the light bulb can be screwed in or out by rotating the pole or telescoping tube.

The problem with all the prior devices has been the danger of the light bulb disengaging from the suction or capture attachment resulting in the light bulb falling. Due to the height of the light bulb, when it falls and shatters the glass shards may cause injury to the light bulb changer as well as any other individual in the immediate area. As the height of the light bulb to be changed increases, small movements by the installer will induce a greater movement at the end of the pole affixed to the light bulb. The unsteady pole movement often results in the bulb striking against the socket, ceiling, fixture or recess wall and dislodging the light bulb or breaking the vacuum seal, resulting in the bulb falling. Additionally, dust and grime build-up on the surface of a light bulb creates an imperfect suction coupling, leading to a premature detachment of the light bulb while it is being held by the suction attachment. The falling light bulb creates a hazardous and dangerous projectile. The invention provides an apparatus and method to catch a falling light bulb which will eliminate the hazard of the falling light bulb and takes the danger out of replacing hard-to-reach overhead light bulbs.

BRIEF SUMMARY OF THE INVENTION

The danger of light bulbs falling when removing and installing light bulbs using extension devices are solved with the invention herein. The invention incorporates a canopy which captures any light bulb which may become dislodged and fall. The canopy is opened prior to removing or installing a light bulb. The canopy in its preferred mode is of a transparent material or open mesh fabric which allows the light bulb changer to view the light bulb from a location beneath the canopy. The canopy operates with expandable ribs to allow adjustment of canopy size and tension as well as provide ease for storage by allowing the canopy to collapse into a closed position.

DETAILED DESCRIPTION OF THE INVENTION

This invention incorporates a canopy which captures any light bulb which may become dislodged and fall during the light bulb changing operation. The canopy is opened prior to removing or installing a light bulb. The canopy in its preferred mode is of a transparent material or open mesh fabric which allows the light bulb changer to view the light bulb from a location beneath the canopy. The canopy operates with expandable ribs to allow adjustment of canopy size and tension as well as provide ease for storage by allowing the canopy to collapse into a closed position.

Figure 1:
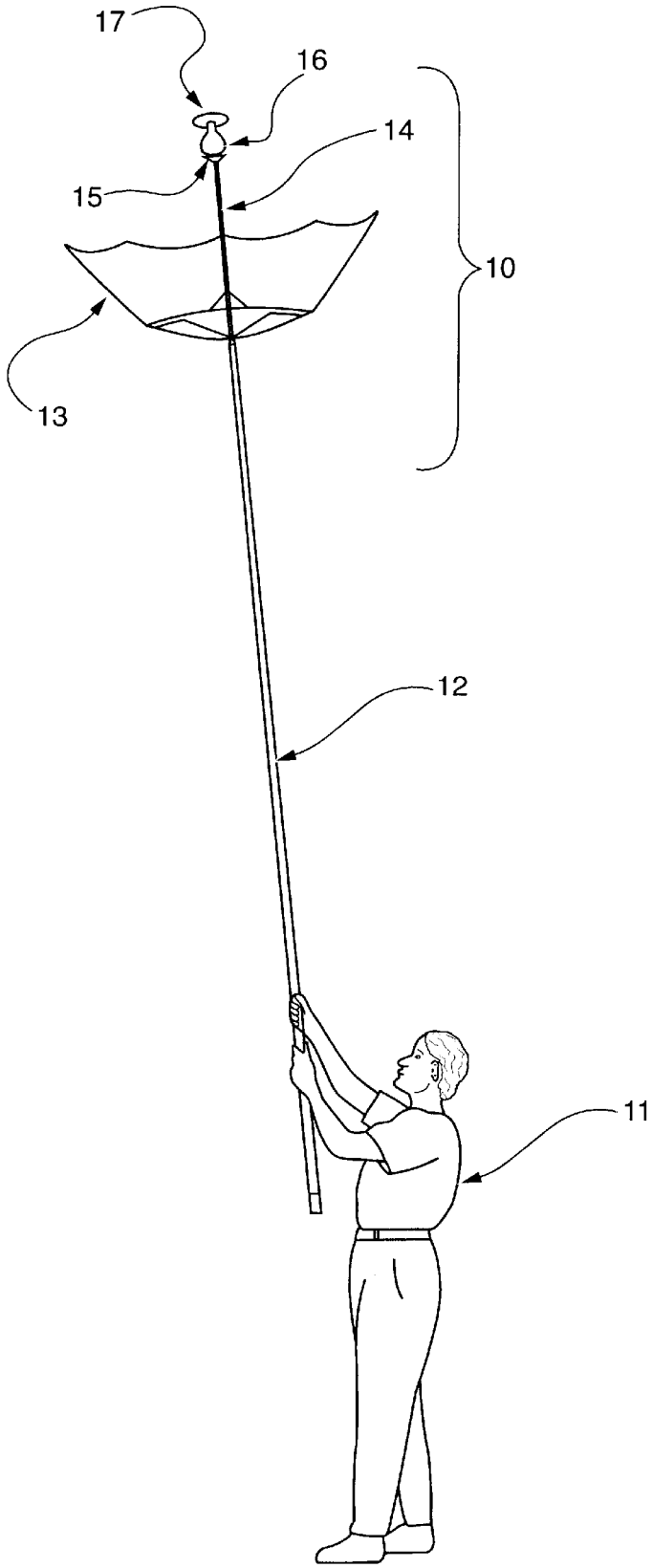
FIG. 1 Conceptual view showing use of the apparatus.

Referring to FIG. 1 we see the light bulb changer 10 in a conceptual view showing the installer 11 using a stick or pole 12 with the canopy 13 open. There is a shaft 14 within the concave portion of the canopy 13 which has an attachment mechanism 15 to attach to a light bulb 16 being inserted into a ceiling light recess 17.

As can be seen in FIG. 1 a small tilting action by the installer 11 results in a large movement of the light bulb 16. As the length of the stick or pole 12 increases, it becomes more difficult for the installer 11 to hold the stick or pole 12 steady. This increases the possibility that the light bulb 16 may hit or contact the edge of the ceiling light recess 17. When this type of contact occurs, the light bulb 16 can disengage from the attachment mechanism 15, resulting in the light bulb 16 falling. The canopy 13 captures the light bulb 16 preventing it from falling and shattering, thus resulting injury and the dangerous condition of broken glass can be avoided.

Figure 2:
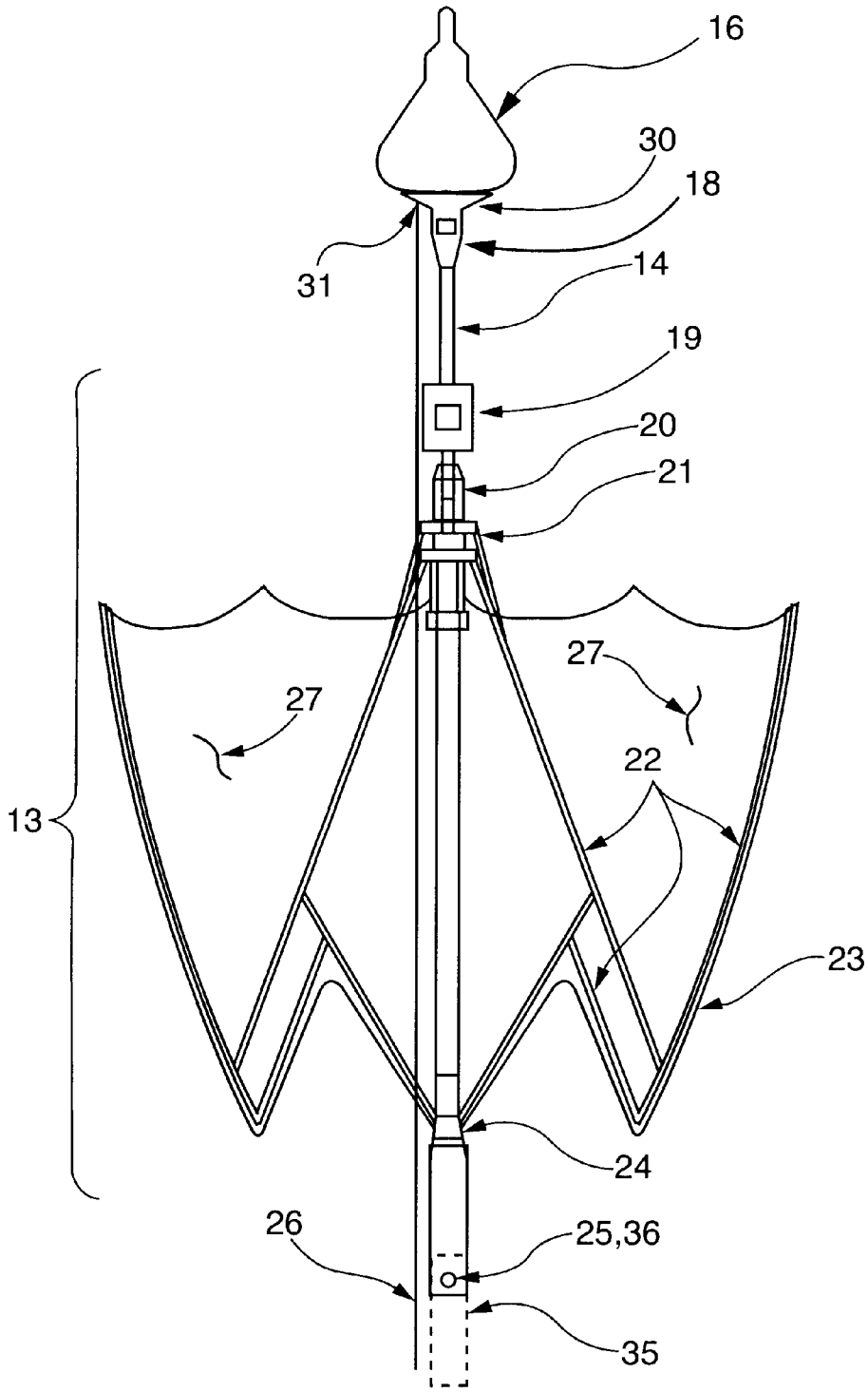
FIG. 2 Side view section of the apparatus in a partially collapsed position.

In FIG. 2 we see the canopy 13 partially closed. The collar 20 of the canopy 13 can be adjusted to preferred position on the shaft 14. This allows the canopy 13 which is supported by ribs 22 which connect to the collar 20 to telescope the canopy 13 outward from the shaft 14 to the desired width and accordingly the desired tension in the canopy material 23.

The canopy 13 can be a fabricated from a variety of flexible canopy materials 23 including but not limited to plastics, nylons, cottons, silks, fabrics, leathers, papers, and metal foils, in both continuous and mesh configurations, if the canopy 13 is collapsible. In its preferred mode, the canopy 13 is collapsible for ease of storage. However, the canopy 13 can also be constructed of a rigid canopy material 23 if it is not desired to close the canopy 13. The canopy 13 can be in the configuration of an umbrella with its concave side 27 facing the end of the shaft 14 that affixes to the light bulb 16. However, the canopy 13 can have alternate configurations including but not limited to oval, pyramid, or V shaped to allow the capture of a falling light bulb 16.

We also see in FIG. 2 a suction cup 30 which is utilized to affix to the light bulb 16. The suction on the light bulb 16 can be broken by pulling on a release string 26 which is attached to the outer surface 31 of the suction cup 30. A spring 21 can be utilized on the shaft 14, with a lock/release button 19 to allow the canopy 13 to open automatically when the lock/release button 19 is depressed. The lock/release button 19 can also have multiple positions for setting the canopy 13 at multiple positions. One end of the canopy 13 is attached to a shaft extension connector 24 which is connected to an interlocking pole 35 of extendable segmented sections to adjust the length desired for the interlocking pole 35. The connection shown for the interlocking pole 35 is by use of an interlocking button 25 which passes through an aligning hole 36 in the shaft extension connector 24.

The mounting stem 18 allows the suction cup 30 to be removed and alternate devices to be affixed to the mounting stem 18. Alternate attachments can be multiple suction devices and devices consisting of a multi-ribbed clasp or a base from which flexible ribs extend which can fit over the light bulb 16 exerting enough pressure on the bulb surface so that the light bulb 16 can be unscrewed and held in the device when sufficient space is available.

Figure 3:
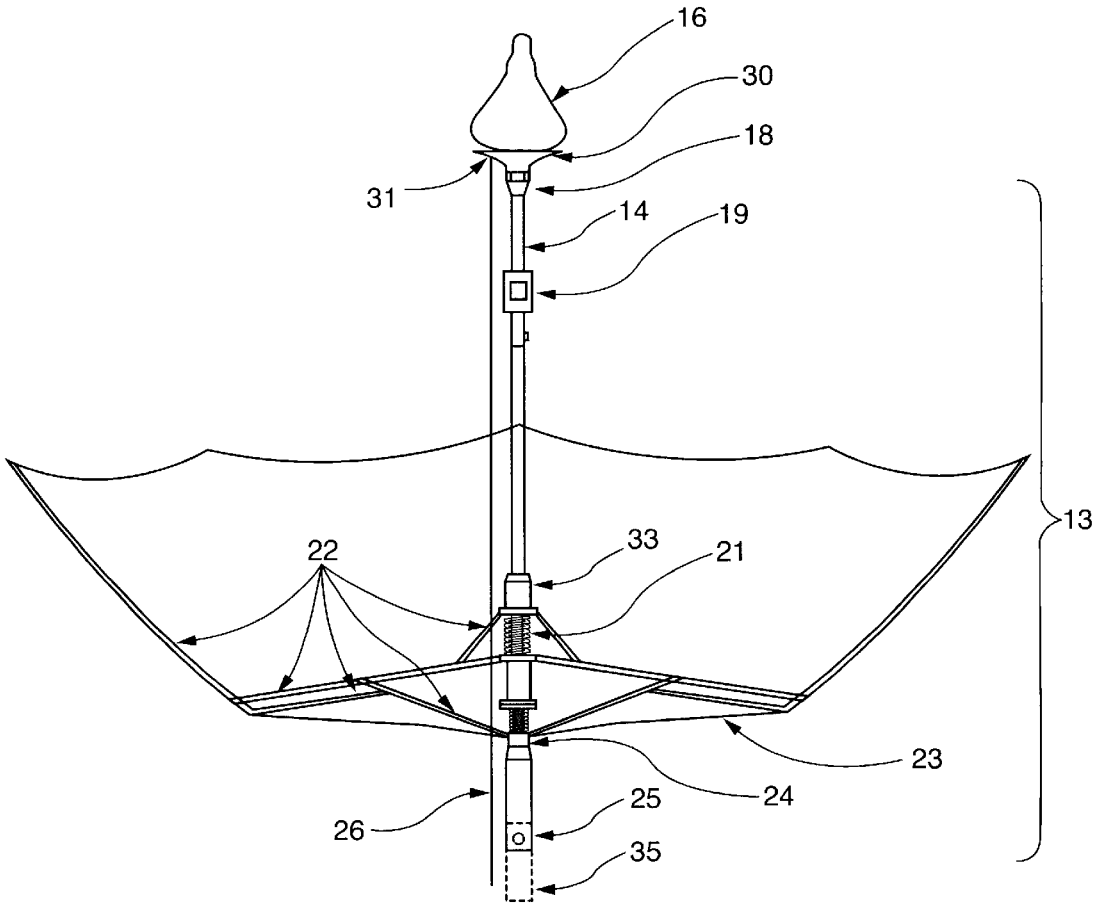
FIG. 3 Side view section with canopy fully expanded.

In FIG. 3 we see the canopy 13 in an open position configuration for the light bulb changer 10. The interlocking pole 35 is shown utilized with an interlocking button 25 which may be a set screw or a retractable pin that passes through the shaft extension connector 24. The canopy 13 has a series of ribs 22 to support the canopy material 23 and allow the canopy 13 to collapse into various positions depending on the location of the deployment collar 33. A spring 21 is shown which allows the canopy 13 to be opened automatically into the fully open position. The shaft 14 has a mounting stem 18 that connects to a suction cup 30 with a rotation lock to prevent rotation.

The suction cup 30 attaches to the light bulb 16 and is released by pulling the release string 26 which is attached to the outer surface 31 of the suction cup 30. The canopy material 23 is preferably transparent, translucent, or a see-through mesh to allow the installer 11 to be able to visually observe the light bulb 16 being removed or installed.

The length of the shaft 14 is preferably greater than the radius of the canopy 13, to make access to the light bulb 16 easy while keeping any falling light bulb 16 within the canopy 13 area.

Figure 4:
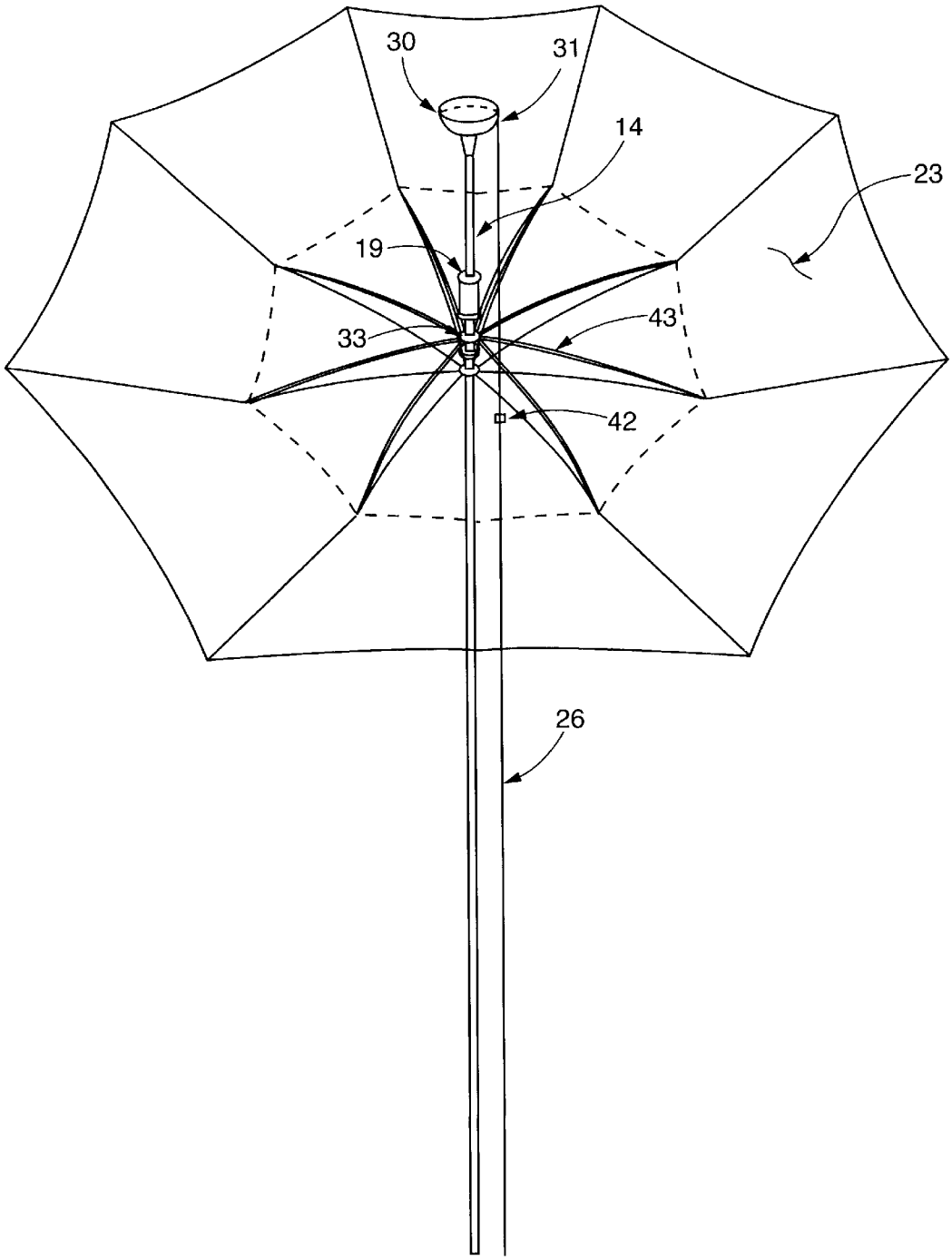
FIG. 4 Top view with canopy fully expanded.

In FIG. 4 we see the device from a top oblique position. The canopy material 23 is supported by an alternate arm configuration 43. A lock/release button 19 is carried on the shaft 14 to allow the position of the canopy 13 to be set as desired. An aperture 42 in the canopy material 23 allows the release string 26 to pass through the canopy 13 and connect with the suction cup 30 at its outer surface 31.

Figure 5:
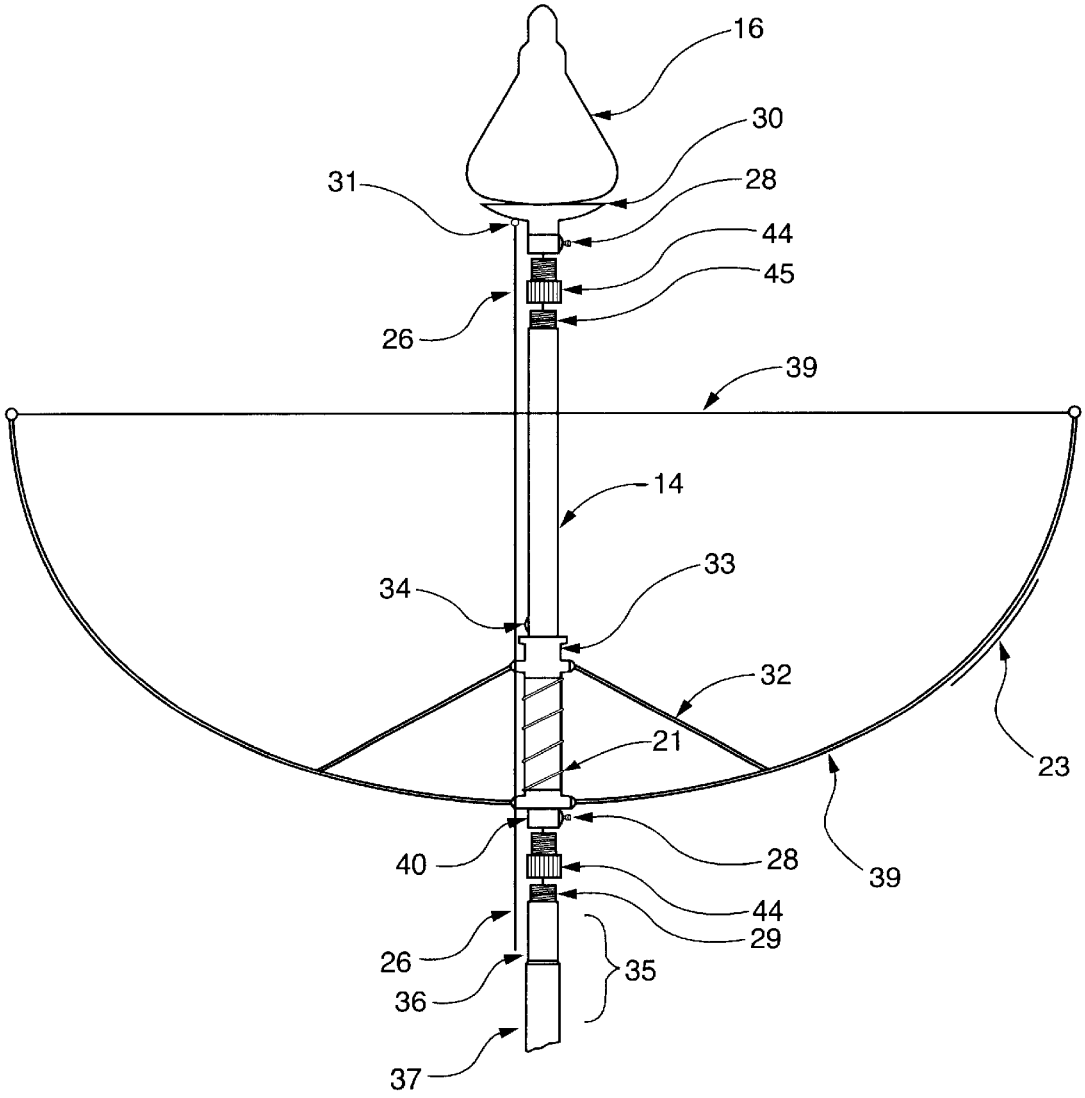
FIG. 5 Side view section with canopy fully open showing alternate frame structure.

In FIG. 5 we see an alternate configuration for the light bulb changer 10. The interlocking pole 35 is shown consisting of telescoping pole sections 36 & 37 which can be locked into any desired length by rotating the relative section in a clockwise direction around the longitudinal axis of the interlocking pole 35 and released by rotation in the opposite direction. The attachment from the interlocking pole 35 to the canopy 13 is shown using threading 29 on the interlocking pole 35, a universal adapter 44 which is inserted into a receiving shaft 40 with a rotation lock 28 to prevent rotation. The canopy 13 has rigid arms 39 to support the canopy material 23, stabilizers 32, and a deployment collar 33. The canopy 13 comprises a spring 21 and is locked in place by a collar locking pin 34 being retractable in the shaft 14. The shaft 14 has threading 45 on its end, with a universal adapter 44 if needed, to connect to a suction cup 30 with rotation lock 28 to prevent rotation.

The suction cup 30 attaches to the light bulb 16 and is released by pulling the release string 26. The canopy material 23 is preferably transparent, translucent, or a see through mesh to allow the installer 11 to visually observe the light bulb 16 being removed or installed.

The length of the shaft 14 is preferably greater than the radius of the canopy 13, to make access to the light bulb 16 easy and keep any falling light bulb 16 within the canopy area.

The method of this invention includes the steps of:

fabricating a canopy 13 which is in the shape of a truncated convex surface;

connecting a stick or pole 12 at the apex of the convex surface of the canopy 13;

connecting a shaft 14 to the canopy within the concave portion of the canopy 13;

attaching a suction cup 30 to the end of the shaft 14;

affixing the suction cup 30 to the light bulb 16 that is to be installed or removed.

The features of my invention are as follows:

1. Provides an extension pole to reach high or inaccessible locations to install or remove a light bulb without danger from movement of the pole.
2. Allows the installer the ability to set the canopy for the desired size.
3. Allows the installer the ability to fully view the light bulb from below when it is being installed or removed while being protected by the canopy from the falling light bulb.
4. Provides a protective canopy that will capture any falling light bulb or any light bulb that has been removed or dislodged from the suction cup or other retractor device.

The invention may be embodied in many other specific forms without departing from the spirit or essential characteristics of the invention. The embodiments are therefore to be considered in all respects as illustrative and not restrictive.

We claim:

1. A device for installing and removing light bulbs located at an elevated position from a floor comprising:

a pole, wherein said pole defines an axis;

a canopy connected at an end of said pole, wherein said canopy is comprised of a flexible material mounted on arms that allow said canopy to collapse into a plurality of positions;

a shaft connected to said canopy along said axis of said pole; and an attachment mechanism connected to an end of said shaft.

2. The device of claim 1, wherein said pole consists of telescoping tubes.

3. The device of claim 1, wherein said attachment mechanism comprises a suction cup.

4. The device of claim 3, wherein said suction cup includes a plurality of suction cups.

5. The device of claim 1, wherein said flexible material of said canopy has an aperture to allow a release string to pass through.

6. The device of claim 1, further comprising:

a. an aperture in said flexible material of said canopy, and b. a release string attached to said attachment mechanism;

wherein said release string passes through said aperture in said flexible material of said canopy.

7. The device of claim 1, wherein said canopy has a radius, and wherein said shaft has a length greater than said radius of said canopy.

8. The device of claim 1, wherein said canopy is composed of a transparent material.

9. The device of claim 1, wherein said canopy is composed of a translucent material.

10. The device of claim 1, wherein said canopy is composed of a mesh material.

11. The device of claim 1, further comprising a lock on said shaft to hold said canopy in a set position.

12. The device of claim 3, further comprising a release string attached to an outer surface of said suction cup.

13. A device for screwing in and out a light bulb located at an inaccessible position comprising;

a pole, wherein said pole defines an axis;

a canopy, consisting of a diaphanous material attached to retractable arms and connected to an end of said pole;

a shaft, aligned along said axis of said pole and comprising two ends, one end of said shaft connected to said canopy;

a suction cup, connected to an opposite end of said shaft; and a release string connected to an outer surface of said suction cup.

14. The device of claim 13 wherein said pole is comprised of telescoping tubes.

15. The device of claim 13 further comprising a lock on said shaft to hold said canopy in a set position.

* * * * *